US006336479B1

(12) United States Patent
Nanaji

(10) Patent No.: US 6,336,479 B1
(45) Date of Patent: Jan. 8, 2002

(54) DETERMINING VAPOR RECOVERY IN A FUELING SYSTEM

(75) Inventor: Seifollah S. Nanaji, Greensboro, NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

(21) Appl. No.: 09/499,545

(22) Filed: Feb. 7, 2000

(51) Int. Cl.[7] ..... B65B 31/00; B67C 3/00

(52) U.S. Cl. ..... 141/4; 141/44; 141/45; 141/59; 141/83; 141/94; 141/302

(58) Field of Search ..... 141/2, 4–8, 44, 141/45, 59, 83, 94, 302; 73/40.5 R, 49.1

(56) References Cited

U.S. PATENT DOCUMENTS

| | | | | | |
|---|---|---|---|---|---|
| 3,002,380 | A | | 10/1961 | Grove | 73/168 |
| 3,054,288 | A | | 9/1962 | Bowman et al. | 73/168 |
| 3,225,591 | A | | 12/1965 | Orkney, Jr. et al. | 73/112 |
| 3,763,901 | A | | 10/1973 | Viland | 141/8 |
| 3,926,230 | A | | 12/1975 | Stary et al. | 141/45 |
| 3,940,020 | A | | 2/1976 | McCrory et al. | 222/52 |
| 3,981,335 | A | | 9/1976 | Deters | 141/46 |
| 4,058,149 | A | | 11/1977 | Hansel | 141/301 |
| 4,172,477 | A | | 10/1979 | Reich | 141/8 |
| 4,223,706 | A | * | 9/1980 | McGahey | 141/59 |
| 4,608,857 | A | | 9/1986 | Mertens et al. | 73/40.5 |
| 4,705,459 | A | | 11/1987 | Buisine et al. | 417/53 |
| 4,796,466 | A | | 1/1989 | Farmer | 73/40.5 |
| 4,905,511 | A | | 3/1990 | Reinhold | 73/168 |
| 5,040,577 | A | | 8/1991 | Pope | 141/59 |
| 5,050,092 | A | | 9/1991 | Perry | 364/506 |
| 5,151,111 | A | | 9/1992 | Tees et al. | 55/164 |
| 5,195,564 | A | | 3/1993 | Spalding | 141/1 |
| 5,199,471 | A | | 4/1993 | Hartman et al. | 141/5 |
| 5,213,142 | A | | 5/1993 | Koch et al. | 141/59 |
| 5,269,353 | A | | 12/1993 | Nanaji et al. | 141/59 |
| 5,317,899 | A | | 6/1994 | Hutchinson et al. | 73/40.5 |
| 5,323,817 | A | | 6/1994 | Spalding | 141/1 |
| 5,325,896 | A | | 7/1994 | Koch et al. | 141/59 |
| 5,332,008 | A | | 7/1994 | Todd et al. | 141/5 |
| 5,332,011 | A | | 7/1994 | Spalding | 141/59 |
| 5,365,459 | A | | 11/1994 | Perry | 364/509 |
| 5,429,159 | A | | 7/1995 | Tees et al. | 141/59 |
| 5,450,883 | A | | 9/1995 | Payne et al. | 141/59 |
| 5,671,785 | A | | 9/1997 | Andersson | 141/59 |
| 5,715,875 | A | | 2/1998 | Clary et al. | 141/59 |
| 5,857,500 | A | | 1/1999 | Payne et al. | 141/59 |
| 5,860,457 | A | | 1/1999 | Andersson | 141/59 |
| 5,913,343 | A | | 6/1999 | Andersson | 141/59 |
| 5,944,067 | A | | 8/1999 | Andersson | 141/59 |

FOREIGN PATENT DOCUMENTS

| | | |
|---|---|---|
| WO | WO 00/55047 | 9/2000 |

* cited by examiner

*Primary Examiner*—Timothy L. Maust
(74) *Attorney, Agent, or Firm*—Withrow & Terranova PLLC

(57) ABSTRACT

A vapor recovery system for a fuel dispenser having a valve positioned in the hanging hardware for testing for leaks along a vapor recovery line. Vapor valves placed along the vapor recovery line allow for isolating sections of the recovery line to determine the position of any leaks. A vapor pump positioned on the vapor recovery line provides for changing the pressure within the line and a vapor sensor positioned on the vapor recovery line determines the amount of pressure within the line. A control system controls the vapor pump and valves and receives signals from the pressure sensor for determining the position of leaks along the vapor recovery line.

31 Claims, 4 Drawing Sheets

DETERMINING VAPOR RECOVERY IN A FUELING SYSTEM

FIELD OF THE INVENTION

The present invention is directed to a vapor recovery system and, more particularly, to a vapor recovery system having a valve positioned in the nozzle to assist in determining leaks along the vapor recovery system including the hanging hardware.

BACKGROUND OF THE INVENTION

Vapor recovery equipped fuel dispensers, particularly gasoline dispensers, have been known for quite some time, and have been mandatory in California for a number of years. The primary purpose of using a vapor recovery fuel dispenser is to retrieve or recover vapors that would otherwise be emitted to the atmosphere during a fueling operation, particularly for motor vehicles. The vapors of concern are generally those which are contained in the vehicle gas tank. As liquid gasoline is pumped into the tank, the vapor is displaced and forced out through the filler pipe. Other volatile hydrocarbon liquids raise similar issues. In addition to the need to recover vapors, some states, California in particular, are requiring extensive reports about the efficiency with which vapor is recovered and proof that the vapor recovery systems are working as intended.

A traditional vapor recovery apparatus is known as a "balance" system, in which a sheath or boot encircles the liquid fueling spout and connects by tubing back to a fuel reservoir. As the liquid enters the tank, the vapor is forced into the sheath and back toward the fuel reservoir or underground storage tank (UST) where the vapors can be stored or recondensed. Balance systems have numerous drawbacks, including cumbersomeness, difficulty of use, ineffectiveness when the seals are poorly made, and slow fueling rates.

As a dramatic step to improve on the balance systems, Gilbarco, Inc., assignee of the present invention, patented an improved vapor recovery system for fuel dispensers, as seen in U.S. Pat. No. 5,040,577, now Reissue Patent No. 35,238 to Pope, which is herein incorporated by reference in its entirety. The Pope patent discloses a vapor recovery apparatus having a vapor pump in the vapor return line driven by a variable speed motor. The liquid flow line includes a pulser, conventionally used for generating pulses indicative of the liquid fuel being pumped. This permits computation of the total sale and the display of the volume of liquid dispensed and the cost in a conventional display. A microprocessor translates the pulses indicative of the liquid flow rate into a desired vapor pump operating rate. The effect is to permit the vapor to be pumped at a rate correlated with the liquid flow rate so that, as liquid is pumped faster, vapor is also pumped faster.

Previous systems have been developed to test for leaks in the vapor recovery line. U.S. Pat. Nos. 5,450,883 and 5,857,500 both assigned to Gilbarco, Inc. and incorporated herein by reference in their entirety, disclose vacuum-assisted vapor recovery systems having vapor valves positioned within the vapor recovery line between the nozzle and vacuum pump and between the vapor pump and underground storage tank. Both systems include pressure sensors to detect leaks in the vapor recovery system, and may include a valve in the dispenser nozzle. However, the valves are manually operated requiring trained personnel or technicians to physically open and close the valves in the nozzle and check for leaks in the vapor recovery system.

SUMMARY OF THE INVENTION

The present invention allows for detecting a leak within a vapor recovery system, including the hanging hardware. A valve positioned in the vapor recovery line within the hanging hardware is selectively positionable between open and closed positions. In one embodiment, when the hanging hardware is in an upright, or vertical position such as when not in use, an attitude valve positioned in the nozzle is in a closed position. A vapor pump is positioned on the vapor recovery line downstream of the valve to create a vacuum within the line to draw vapors during the fueling process. A pressure sensor is also located on the vapor recovery line for detecting the amount of pressure within the line. A control system monitors the vapor pump and pressure sensor and compares the sensor readings with values stored in memory. A leak is detected when the detected pressure in the vapor recovery differs from the stored value.

The invention may further include additional valves positioned along the vapor recovery line. Each of the valves is operatively connected to the control system which positions each between open and closed orientations. Leaks in the vapor recovery system can be determined and isolated by testing individual sections of the vapor recovery line and comparing the values. In either embodiment, if the control system identifies a leak, the fueling system may be shut down, or a signal sent to a technician or user indicating the leak and that service is required.

A method of performing the testing along the portions of the vapor recovery line are also included within the invention. One method of testing includes using a single valve within the hanging hardware. When the valve is closed, the vapor pump is initiated and a pressure reading is obtained within the vapor recovery line. The pressure is compared to an expected value previously stored in the control system and if the values differ, a leak is determined to exist.

A second method uses the valve within the hanging hardware, and at least one additional valve placed along the vapor recovery line. A first pressure reading is performed by closing the additional valve and determining the vapor pressure within the line between the additional valve and the vapor pump. The additional valve is then opened, and the hanging hardware valve is closed to determine a second vapor pressure between the hanging hardware valve and the vapor pump. The first and second vapor pressures are compared to determine whether there are any leaks within the vapor recovery line. Additionally, the approximate location of the leak may be determined by comparing the vapor pressures from each section. If both sections indicate a leak, the leak is located at a point shared by both sections. Likewise, if only one section indicates a leak, the leak is located at a point not commonly shared by both sections. Notably, the systems and methods described above can be modified such that a vapor pump creates a positive pressure or a negative pressure in the vapor recovery line.

Another method closes one of the valves and creates a pressure within the vapor recovery line. The pressure, either positive or negative, is determined by the pressure sensor and then maintained for a period of time. Afterwards, the pressure is again tested and a leak within the vapor recovery line will result in a change in the pressure.

DETAILED DESCRIPTION OF THE INVENTION

Figure 1:
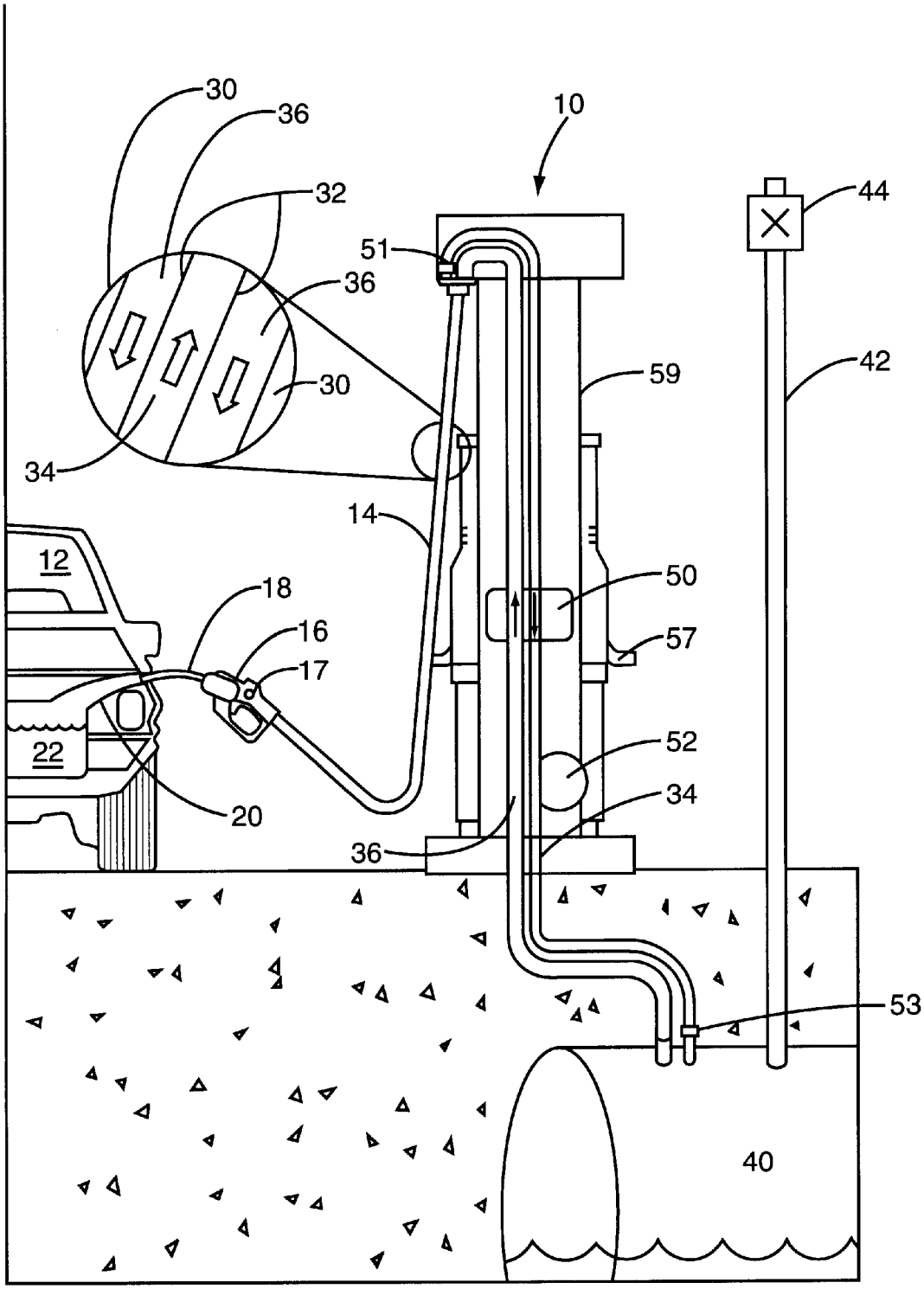
FIG. 1 is a schematic view of a fuel dispenser incorporating a vapor recovery system.

In the following description, like reference characters designate like or corresponding parts throughout the Figures. Also, terms such as "forward", "backward", "left", "right", "upwardly", "downwardly", and the like are words of convenience and are not to be construed as limiting terms. Certain modifications and improvements will occur to those skilled in the art upon a reading of the following description. It should be understood that all such modifications and improvements have been deleted herein for the sake of conciseness and readability but are properly within the scope of the claims.

The present invention is directed to a vapor recovery system for a fuel dispenser having a valve positioned in the hanging hardware to assist in leak detection. Placement of the valve within the hanging hardware allows for the nozzle and/or delivery hose to be tested for leaks. The valve adjusts between open and closed orientations and additional vapor valves placed along the vapor recovery line allow for isolating sections to determine the position of any leaks. A pressure sensor positioned in the vapor recovery line determines the amount of pressure within the line. The pressure values are compared to determine if there is a leak within the line and the approximate position of the leak. The term "changing hardware" is understood to mean the parts of the vapor recovery line extending outside of the fuel dispenser housing, such as the delivery hose 14 and nozzle 16.

Turning now to FIG. 1, a fuel dispenser 10 is adapted to deliver fuel, such as gasoline or diesel fuel, to a vehicle 12. The fuel is stored in an underground storage tank (UST) 40 and is pumped by a fuel pump (not shown) through a fuel delivery line 36 to the nozzle 16. Preferably, the vehicle 12 includes a fill neck 20 and a tank 22, which accepts the fuel and provides it through appropriate fluid connections to the engine (not shown) of the vehicle 12.

Figure 2A:
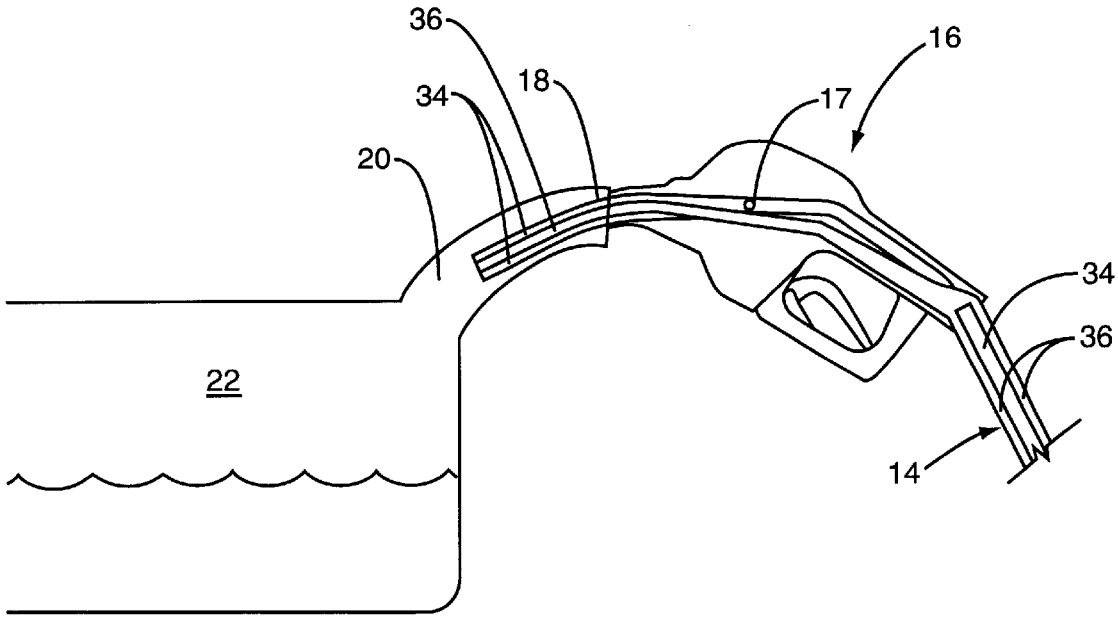
FIG. 2A is a schematic illustration of a nozzle having an attitude valve in an open position.
Figure 2B:
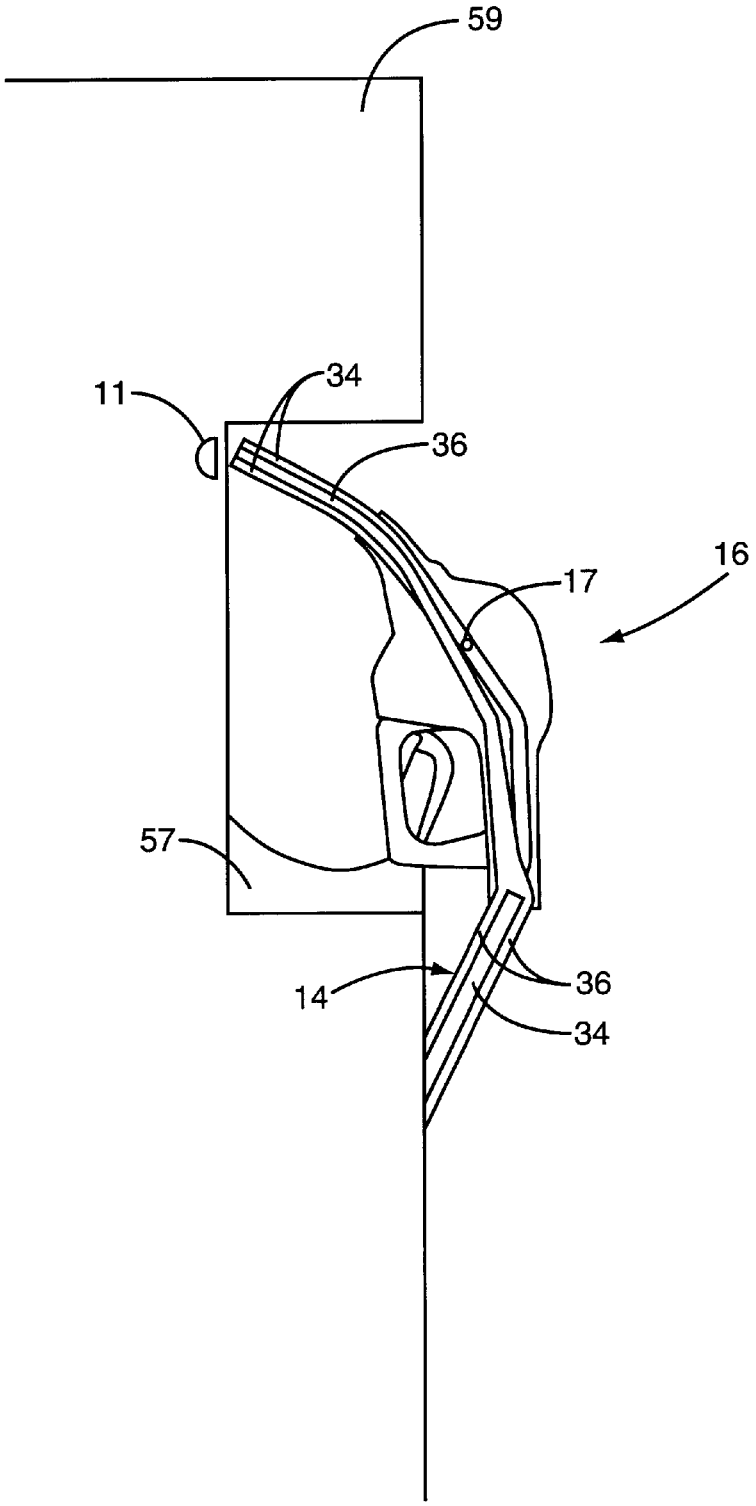
FIG. 2B is a schematic illustration the nozzle of FIG. 2A in an upright position with the attitude valve closed.

The nozzle 16 and delivery hose 14 include both the product delivery line 36 and a vapor return line 34 as illustrated in FIGS. 1, 2A, and 2B. Preferably, the spout 18 has the product delivery line 36 positioned within an inner section with the vapor recovery line 34 extending around the outer spout edge. The spout 18 may further include apertures (not shown) for capturing vapor emanating in the vehicle tank 22. The product delivery line 36 and vapor recovery line 34 are further aligned within the delivery hose 14 preferably with the product line extending along an annular outer portion and the vapor line within an interior portion. The vapor recovery line 34 extends through the dispenser 10 and terminates in the UST 40. The UST 40 may also be equipped with a vent shaft 42 and a vent valve 44. During delivery of fuel into the vehicle tank 22, and returning fuel vapor into the UST, air may be vented through the vent shaft 42 and valve 44 to equalize the pressure within the tank.

A housing 59 extends around the above ground section of a fuel dispenser as illustrated in FIG. 1 for protecting the fuel dispenser elements. Preferably, the only elements placed outside of the housing 59 are the delivery hose 14 and nozzle 16. The housing 59 further includes a nozzle boot 57 for mounting the nozzle 16 when not in use. The nozzle 16 is maintained in an upright, vertical position while being stored in the boot 57.

A valve 17 is positioned within the nozzle 16 for selectively opening and closing the vapor return line 34. One embodiment features an attitude valve, as illustrated in FIGS. 2A and 2B, that automatically adjusts between opened and closed positions depending upon the orientation of the nozzle 16. In one attitude valve embodiment, the attitude valve 17 includes a two-chamber orientation with a ball contained therein for selectively opening and closing the vapor return line depending upon the nozzle orientation as disclosed in U.S. Pat. No. 4,058,149, herein incorporated by reference in its entirety.

The attitude valve 17 maintains a closed position when the nozzle 16 is held or stored in a vertical position such as positioned on the dispenser boot 57. When the nozzle 16 is in a horizontal position such as during the fueling process illustrated in FIGS. 1 and 2A, the attitude valve 17 is in an open position allowing for vapor recovery. The degree of tilt at which the attitude valve 17 opens and closes may vary and be adjusted for a variety of embodiments. In one embodiment, a tilt angle of greater than about forty-five degrees closes the attitude valve 17.

Other valve designs are also available for opening and closing the vapor return line such as a solenoid valve, or a valve operated via RF signals. These other designs may not require the valve 17 to be in a particular orientation, but rather are positively controlled by a signal from the control system 50, or other source. In one embodiment, the valve 17 is controlled by the control system 50 dependent upon the actuation of the fuel delivery system. The valve 17 is closed when the fuel delivery system is off and not pumping fuel through the product delivery line 36, and opened when the dispenser is actuated.

Another embodiment includes a sensor 11 positioned adjacent to the boot 57 and in communication with the control system 50 to sense the placement of the nozzle 16 within the dispenser housing. The sensor 11 may also be a reed switch positioned within the dispenser boot 57 that is moved between on and off positions by the placement of the nozzle 16. When the nozzle 16 is within the boot 57, the control system 50 closes the valve 17. Alternatively, when the nozzle 17 is away from the boot 57, the valve 17 is open as it is assumed that vapor recovery is necessary. This assumption provides for vapor leak testing without a user or operator manually toggling the valve between an on and off position. Additional types of valves may include spring loaded valves, and electrically controlled valves.

Preferably, the valve 17 is positioned within the nozzle 16. However, the valve 17 may also be positioned in other locations along the length of the delivery hose 14.

A vapor pump 52 provides a vacuum for pulling vapor at the spout 18 into the vapor recovery line 34 and propelling the vapor into the underground storage tank 40. The vapor pump 52 may additionally supply a vacuum or positive pressure in the vapor recovery line during testing to locate any possible leaks. Alternatively, a separate vapor pump (not shown) may be positioned along the vapor recovery line 34 for either supplying or removing air for testing purposes.

Vapor valves 51 may be positioned at various points in the vapor recovery line 34 for testing different sections of the line for leaks. Preferably, a second vapor valve 51 is located just upstream of the hanging hardware. Additional valves may also be positioned along the vapor recovery line 34 for isolating smaller sections of the line, as well as downstream of the vapor pump 52 such as valve 53 positioned in proximity to the underground storage tank 40.

The vapor pump 52 and vapor valve 51 allows for three basic embodiments to control vapor flow during fueling operations. The first embodiment is a constant speed vapor pump with the vapor valve 51 being selectively positionable in either an open or closed position. The second embodiment is a vapor pump driven by a constant speed motor with vapor valve 51 selectively positionable at a variety of positions and adjusted to increase or decrease the flow of vapor. The third embodiment is a variable speed motor and pump in combination with valve 51 adjustable between either an open or closed alignment. One type of variable speed motor and pump is that described in U.S. Pat. No. 5,040,577, now reissue patent no. 35,238.

Connected between vapor valve 51 and vapor pump 52 is a pressure sensor 71. Pressure sensor 71 measures the pressure in the vapor return line 34 between the vapor valve 51 and the vapor pump 52. Other pressure sensors may also be positioned along the vapor return line 34, such as an outlet pressure sensor 73 that measures the pressure between the vapor pump 62 and vapor valve 53.

Figure 3:
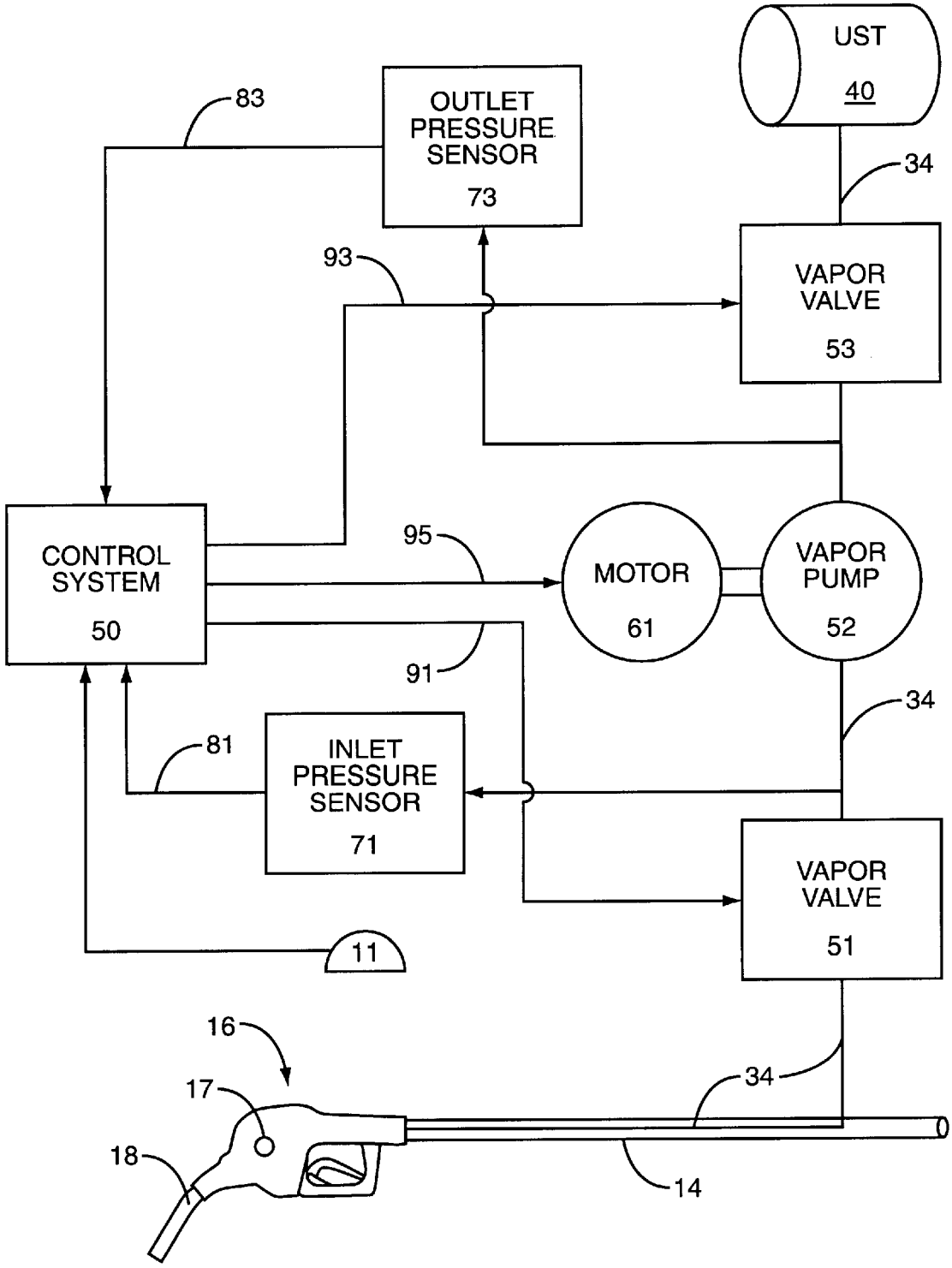
FIG. 3 is a schematic view of a preferred embodiment of a vapor recovery system of the present invention.

A control system 50 is connected to pressure sensors 71,73 through pressure signal input lines 81 and 83, respectively as illustrated in FIG. 3. The pressure signal input lines 81,83 allow pressure signals produced by pressure sensors 71,73 to be transmitted and input to the control system 50. The pressure signals are processed and compared to stored reference pressure values to determine if an error condition exists in the vapor recovery system 10, according to a routine controlled by the control system 50. Instructions for the routine and data used in the routine may be stored in a conventional memory unit such as a ROM, PROM or flash memory accessible by the control system 50.

The reference pressure values correspond to the pressure that should exist in the sections of the vapor recovery line 34 at the selected pump speed in the absence of either a leak in the line or a deficiency in the pump. The reference pressure values can be determined through empirical testing. A table of reference with pressure values corresponding to various pump speeds and vapor recovery line sections is stored in the control unit 50 to allow for testing at various pump speeds, vapor pump directions, and valve settings. Preferably, values exist for each of the various settings of the vapor pump 52 and the valves. Further, these may be positive or negative pressures depending upon the manner of leak testing.

Control system 50 is connected to the vapor valves 51, 53 through valve control lines 91,93, respectively and to a motor 61 through control line 95. Control system 50 actuates vapor valves 51, 53 and controls motor 61 to permit testing of the vapor recovery system 10.

In use, a number of testing procedures are available for determining the existence of a leak within the vapor recovery system. A first testing procedure is performed with the hanging hardware valve 17 closed and the other valves upstream of the vapor pump 52 open. With an attitude valve, the control system 50 receives a signal from the sensor 11, or other indication that the nozzle is positioned within the boot 57. The control system 50 then signals the vapor pump 52 to operate at a predefined level. The pressure sensor 71 detects the pressure generated in the vapor recovery line 34 and signals the control system 50. The control system 50 compares the received pressure values with those stored in memory. If the values are comparable, the control system 50 determines that no leaks exist and the vapor recovery system is operating effectively. If the measured values differ from those stored in memory, the control system recognizes a problem with the vapor recovery system and may shut down the fuel dispenser 10, send a signal to an operator that a problem has occurred, or other like procedures.

The control system 50 may also allow for acceptable ranges of leakage. By way of example, if the measured values are within a predetermined percentage of the saved results, the control system 50 may allow for the fuel dispenser to remain operational, but send a message to an operator indicating that the vapor recovery system may be in need of service. Once the leakage level exceeds the predetermined percentage, the control system 50 could shut down the fuel dispenser 10, notify a central office, or notify attendant personnel.

The values stored in memory may be periodically changed or updated. Initially, the values stored in the memory may correspond to optimal vapor pressures of a new or properly functioning vapor recovery system. Variables such as amount of operating time, weather conditions, etc., may change the efficiency of the vapor recovery system. After a period of use, the vapor recovery system may be serviced and recalibrated and the updated amounts entered into the memory and used for comparison purposes.

A second testing procedure requires comparing the pressure levels along different portions of the vapor recovery line 34. A first test is performed with the vapor valve 51 closed, and the remainder of the downstream valves to the vapor pump 52 open. These registered values are monitored and stored within the control system 50. A second test is then performed with the vapor valve 51 opened, and the valve 17 in the closed position. The second test values are determined and compared against the results of the first test. A leak detected in the first test indicates a vapor leak between the vapor valve 51 and vapor pump 52. A leak detected in the second test indicates a leak between the valve 17 and the vapor valve 51. The hanging hardware may be checked in this manner when the valve 17 is placed in the nozzle 16, and the vapor valve 51 placed where the delivery hose 14 enters the dispenser housing 59.

In a third testing procedure, a section of the vapor recovery line 34 is pressurized and maintained for a period of time to determine whether there are any leaks. A pressure, either positive or negative, is created within at least a portion of the vapor recovery line 34. The pressure is then determined by the pressure sensor located along the portion of the vapor recovery line 34 and stored at the control system 50. The pressure in the portion is maintained for a predetermined period of time, and the pressure is again determined and sent to the control system 50. Changes in the pressure level between the first and second readings indicate the existence of a leak.

Additional valves may be placed along the vapor recovery line 34 for isolating sections for determining the position of an expected leak. Several testing procedures are discussed in U.S. Pat. Nos. 5,450,883 and 5,857,500. Those skilled in the art will recognize additional testing protocols using the valve positioned within the hanging hardware.

Testing may be performed at a variety of time instants. The control system 50 may be programmed to test at preset intervals. Alternatively, the testing may be initiated by a fueling station attendant or other personal and performed on an as-needed basis. Additionally, the test may be initiated from a remote, central office or may be initiated by a standards board or other like compliance organization.

A log file may be maintained within the control system 50 indicating the results of the pressure tests. The log file may also be maintained at a site controller or central controller.

What is claimed is:

1. A system for detecting leaks within a vapor recovery system comprising:

a fuel dispenser having hanging hardware;

a vapor recovery line extending through said fuel dispenser and hanging hardware;

a valve located in said vapor recovery path within said hanging hardware and being selectively positionable between an open position allowing vapor flow through said vapor recovery line and a closed position blocking vapor flow through said vapor recovery line depending upon the orientation of said hanging hardware;

a vapor pump operatively associated with the vapor recovery line;

a pressure sensor connected in the vapor recovery line between said valve and said vapor pump;

a control system operatively connected to said pressure sensor and said vapor pump, said control system activating said vapor pump when said valve is in said closed position and receiving a signal from said pressure sensor indicative of the pressure along said vapor recovery line;

a fuel dispenser housing for containing said hanging hardware when not in use, said hanging hardware being placed in an upright position with said valve in said closed orientation; and a sensor positioned within said fuel dispenser housing for sensing the presence of said hanging hardware, said sensor operatively connected to said control system.

2. The system of claim 1, wherein said valve is an attitude valve.

3. The system of claim 1, wherein said valve is positioned within a nozzle.

4. The system of claim 1, wherein said control system includes a memory for storing predetermined pressure readings, and said control system compares signals received from said pressure sensor with said predetermined pressure readings for determining the existence of a leak within said vapor recovery line.

5. The system of claim 4, wherein said control system is operative to effectively stop fuel flow to said fuel dispenser in response to sensing an error condition.

6. The system of claim 1, wherein said vapor pump creates a positive pressure within said vapor recovery line for determining the existence of a leak.

7. The system of claim 1, wherein said vapor pump creates a negative pressure within said vapor recovery line for determining the existence of a leak.

8. The system of claim 1, further including a second valve positioned within said vapor recovery line between said valve and said vapor pump, said second valve being operatively connected to said control system and being selectively adjustable between open and closed positions.

9. The system of claim 8, further including a second pressure sensor positioned along said vapor recovery path.

10. The system of claim 1, wherein said valve is operatively connected to and actuated by said control system.

11. A vapor recovery system comprising:

a fuel dispenser having a nozzle;

a vapor recovery line extending between said nozzle and a vapor recovery reservoir;

a first valve positioned within said nozzle and being selectively positionable dependent upon the orientation of said nozzle between an open position allowing vapor to flow through said vapor recovery line and a closed position preventing vapor from flowing through said vapor recovery line;

a vapor pump operatively connected to said vapor recovery line;

a second valve positioned between said first valve and said vapor pump and selectively positionable between an open position allowing vapor to flow through said vapor recovery line and a closed position preventing vapor from flowing through said vapor recovery line;

a pressure sensor connected in said vapor recovery line between said second valve and said vapor pump for sensing pressure within said vapor recovery line;

a control system operatively connected to said vapor pump, second valve, and pressure sensor, said control system activating said vapor pump and receiving signals from said pressure sensor indicative of the pressure within said vapor recovery line;

a fuel dispenser housing for containing said nozzle when not in use in a position such that said first valve is in said closed position; and a sensor positioned within said fuel dispenser housing for sensing the presence of said nozzle, said sensor operatively connected to said control system.

12. The system of claim 11, further including at least one additional valve positioned between said first valve and said vapor pump, each of said at least one additional valves being operatively connected to said control system and selectively adjustable between an open position and a closed position.

13. The system of claim 12, wherein said second valve and said at least one additional valve may be opened and closed independently of one another for isolating sections of said vapor recovery line.

14. The system of claim 11, further including at least one additional pressure sensor positioned along said vapor recovery line.

15. The system of claim 11, further including a fuel delivery line extending along a portion of said vapor recovery line for delivering fuel from a reservoir.

16. The system of claim 15, wherein said control system is operative to effectively stop the flow of fuel through said fuel delivery line in response to sensing an error condition.

17. The system of claim 11, wherein said first valve is selectively controlled by said control system.

18. The system of claim 11, wherein said first valve is an attitude valve.

19. The system of claim 11, wherein said vapor pump creates a positive pressure within said vapor recovery line.

20. The system of claim 11, wherein said vapor pump creates a negative pressure within said vapor recovery line.

21. The system of claim 11 wherein said control system further includes a memory and a processor.

22. A method of determining vapor leaks within a vapor recovery system of a fuel delivery system, said method comprising the steps of:

closing a first valve positioned within a nozzle of a vapor recovery line when a fuel delivery system is not dispensing fuel;

activating a vapor pump positioned along the vapor recovery line to create a pressure within the vapor recovery line; determining the pressure within the vapor recovery line between the first valve and the vapor pump;

comparing the pressure from the vapor recovery line with a predetermined value maintained at a control system;

detecting the presence of the nozzle within a fuel housing prior to activating the vapor pump.

23. The method of claim 22, further including automatically opening the valve when the nozzle is in a horizontal orientation and closing the valve when the nozzle is in a vertical orientation.

24. The method of claim 22, further including stopping the flow of fuel through the fuel delivery system upon the determination of a leak.

25. The method of claim 24, further including sending a signal to an outside source indicating the leak within the vapor recovery line.

26. The method of claim 22, further including operating the vapor pump at a plurality of speeds for pulling vapor into the vapor recovery line.

27. The method of claim 22, further including providing at least one additional valve along the vapor recovery line for isolating and testing portions of the vapor recovery line.

28. A method of detecting a leak within a vapor recovery system comprising the steps of:

closing a first valve positioned along a vapor recovery line;

operating a vapor pump positioned on the vapor recovery line downstream of the first valve;

determining a first pressure within the vapor recovery line between the first valve and the vapor pump;

opening the first valve, closing a hanging hardware valve, and determining a second pressure within the vapor recovery line between the hanging hardware valve and the vapor pump;

comparing the first and second pressures; and detecting the presence of the hanging hardware within a fuel housing prior to activating the vapor pump.

29. The method of claim 28, further including comparing the first pressure with a predetermined value stored in a control system for determining the existence of a leak within the vapor recovery system between the vapor pump and the first valve.

30. The method of claim 28, further including positioning additional valves along the vapor recovery line, each of the additional valves being independently operable for positioning in closed and opened orientations for isolating sections of the vapor recovery line.

31. A method of determining a vapor leak along a vapor recovery system comprising the steps of:

closing a first valve positioned along a vapor recovery line with hanging hardware of a fuel dispenser;

activating a vapor pump positioned along the vapor recovery line to create a pressure within the vapor recovery line;

determining a first pressure within the vapor recovery line;

after a predetermined period of time, determining a second pressure within the vapor recovery line;

comparing the first and second pressures; and detecting the presence of the hanging hardware nozzle within a fuel housing prior to activating the vapor pump.

* * * * *